US008209807B2

(12) United States Patent
Chandler

(10) Patent No.: US 8,209,807 B2
(45) Date of Patent: Jul. 3, 2012

(54) AUTOMATIC CLEANING DEVICE FOR A SURFACE SUBMERGED IN A LIQUID

(75) Inventor: Michael Chandler, Flimwell Wadhurst (GB)

(73) Assignee: Kokido Limited, Hong Kong (CN)

( * ) Notice: Subject to any disclaimer, the term of this patent is extended or adjusted under 35 U.S.C. 154(b) by 622 days.

(21) Appl. No.: 12/194,557

(22) Filed: Aug. 20, 2008

(65) Prior Publication Data

US 2009/0089945 A1 Apr. 9, 2009

(30) Foreign Application Priority Data

Oct. 8, 2007 (FR) ..... 07 58136

(51) Int. Cl.
*E04H 4/16* (2006.01)
*F16K 15/14* (2006.01)

(52) U.S. Cl. ..... 15/1.7; 210/167.16; 210/241; 137/855

(58) Field of Classification Search ..... 15/1.7; 137/855; 210/416.2, 460, 167.16, 167.17
See application file for complete search history.

(56) References Cited

U.S. PATENT DOCUMENTS

| | | | | |
|---|---|---|---|---|
| 4,208,752 | A * | 6/1980 | Hofmann | 15/1.7 |
| 6,292,969 | B1 * | 9/2001 | Supra | 15/1.7 |
| 6,662,394 | B2 * | 12/2003 | Balint | 15/1.7 |
| 7,754,073 | B2 * | 7/2010 | Nielsen | 210/170.04 |

FOREIGN PATENT DOCUMENTS

| | | | |
|---|---|---|---|
| EP | 559477 | A1 * | 9/1993 |
| WO | 00/40826 | A | 7/2000 |
| WO | WO 00/40826 | * | 7/2000 |
| WO | WO 0040826 | * | 7/2000 |
| WO | 2005/038170 | A1 | 4/2005 |

* cited by examiner

*Primary Examiner* — Monica Carter
*Assistant Examiner* — Stephanie Newton
(74) *Attorney, Agent, or Firm* — Young & Thompson

(57) ABSTRACT

Automatic cleaning device (1) for a surface submerged in a liquid, designed to be connected to a pump, includes: a hollow head (2) that has a seat (11), first intake hose (5*a*) and second intake hose (5*b*) emptying into said hollow head (2), the seat (11) delimiting a space in which a flap valve (4) is housed, said flap valve (4) being able to work with said seat (11) so as to switch to the first and second blocking positions in which it respectively blocks the first intake hose (5*a*) and second intake hose (5*b*) during the operation of said device (1), characterized in that a prefilter (9) is placed in the hollow head (2) so as to keep the flap valve (4) from being clogged in the space.

8 Claims, 3 Drawing Sheets

AUTOMATIC CLEANING DEVICE FOR A SURFACE SUBMERGED IN A LIQUID

This invention relates to a device for cleaning a surface submerged in a liquid, and in particular an automatic swimming-pool cleaning device that is equipped with a low-power pump. This invention also has as its object the use of said device so as to clean the surfaces submerged in a liquid, such as the bottom, the walls, the submerged area, and the water line of a swimming pool.

A device for cleaning a surface submerged in a liquid can be used so as to clean and/or to remove all types of debris, such as leaves, insects or various kinds of debris that can be found in, for example, the basin of a swimming pool during its use.

Various automatic swimming-pool cleaning devices are known in the prior art. For example, the cleaning of a swimming pool can be done by a process that uses the return of water or a process that uses the suction of the swimming pool pump. In the latter case, these devices comprise either a so-called hammer (flap valve) system, or a so-called membrane system. In particular, they pull in the water and the debris that are present in the water by simple connecting to a sweep intake or to a skimmer (nonreturn water intake directing the water to the filter) of the swimming pool.

In particular, the document FR 2 302 151 describes an automatic swimming-pool cleaning device. This device comprises a cleaning head that has a peripheral region that can be engaged on the surface to be cleaned and disengaged therefrom; two intake passages emptying into said head through two flap seats; and a flap valve for automatically transferring a liquid flow through the passages, alternately and on several occasions from one passage to the next. During the suction of water through the pump, the water will flow through one or the other of the passages (the one that is not blocked by the flap valve) and will achieve adequate kinetic energy such that when the liquid flow is going to be transferred to the other passage (due to the pressure difference between the upper ends of the seats that causes the tipping of the flap toward the passage that was not
blocked), an adequate amount of energy is transferred to the device to move it along the surface to be cleaned. This device can also comprise an intermediate part that is located in front of the flap valve.

However, this device has the drawback of not being suitable for small and medium swimming pools that use a low-power pump, i.e., on the order of 100 watts or less.

The document U.S. Pat. No. 6,298,513 describes a cleaning robot for a swimming pool that also comprises two hoses that may or may not be parallel and one of whose ends is connected to a flexible intake pipe, itself connected to the filtering pump of the swimming pool. The other end of the hoses is fed the suctioned water intermittently by a flap valve that is mounted on a pivot that can start by itself. Using the alternating movement of the flap valve that provides water to the two hoses, kinetic forces are generated that make it possible for the robot to move over the surface of the swimming pool. The cleaning robot as described in this document is also characterized by a large intake opening (water passage): the thickness of the flap valve does not exceed 70% of the intake opening. The purpose of the robot as described in this document is to collect and draw in the dust but also large pieces of debris, and leaves to the filtration system of the swimming pool. This is why, in this device, there is no intermediate part located in front of the valve.

This device generally requires the use of a powerful pump, approximately 600 watts, so as to be feasible. In addition, it has the drawback of quickly fouling the filtration system of the swimming pool, particularly if it involves a cartridge filtration, since it draws in leaves and other debris.

Currently, so as to clean these small and medium swimming pools, there are manual devices.

The latter have the drawback, however, of requiring the intervention of the user for the entire cleaning period.

The object of this invention is to propose a new cleaning device that avoids all or part of the above-mentioned drawbacks.

For this purpose, the invention has as its object an automatic cleaning device for a surface submerged in a liquid, designed to be connected to a pump, comprising: a hollow head that has a seat, first and second intake hoses emptying into said hollow head, the seat delimiting a space in which a flap valve is housed, said flap valve being able to work with said seat so as to switch to the first and second blocking positions in which it respectively blocks the first and second intake hoses during the operation of said device, characterized in that a prefilter is placed in the hollow head so as to keep the flap valve from being clogged by any debris in said space.

Advantageously, the ratio between the width of the valve and the width of said space at the level of a section (S) of said space is greater than 70%.

In addition, using these characteristics, the speed of the water passing between the seat and the flap valve is increased such that said device does not require a high-power pump (for example on the order of 600 watts) to operate. For example, it can operate with a pump with a power on the order of 100 watts or less. In addition, the use of a prefilter in parallel keeps the flap valve from being clogged by any debris.

Preferably, said seat has first and second faces, said valve also has first and second faces, whereby said first faces or said second faces work together to block the intake hoses alternately.

According to a characteristic of the invention, the angle between the first and second faces of the flap valve can be adjusted.

This characteristic makes it possible to vary the thickness of the valve, i.e., the spacing between the first and second faces of said valve based on the power of the pump.

Preferably, said valve is at least partially hollow.

Advantageously, the valve comprises a spacer part that is arranged between its first and second faces.

According to another characteristic of the invention, the length of said spacer part can be adjusted.

Advantageously, the section (S) is perpendicular to the bisector (B) of the first and second faces of the seat.

Preferably, the hollow head has a flat surface that is designed to be opposite the submerged surface, whereby the first and second intake hoses have a slope of between 20° and 30°, preferably on the order of 25°, relative to the plane of the flat surface.

Thus, said device can operate in fairly shallow water.

The invention also has as its object the use of said device according to one of the preceding characteristics for the cleaning of the submerged surfaces of a swimming pool, such as the bottom, the walls, the submerged area, and the water line of a swimming pool.

This invention can also relate to an automatic cleaning device for a surface that is submerged in a liquid, designed to be connected to a pump, comprising: a hollow head that has a seat, first and second intake hoses emptying into said hollow head, the seat delimiting a space in which a flap valve is housed, said flap valve being able to work with said seat so as to switch to the first and second blocking positions in which it blocks respectively the first and second intake hoses during the operation of said device, characterized in that said seat has first and second faces, whereby said valve also has first and second faces, and said first faces or said second faces work together for blocking the intake hoses alternately, and characterized in that the angle between the first and second faces of the flap valve can be adjusted.

The invention will be better understood, and other objects, details, characteristics and advantages of the latter will emerge more clearly during the following description of a particular embodiment of the invention, provided only by way of illustration and not limiting, with reference to the accompanying drawings.

Figure 1:
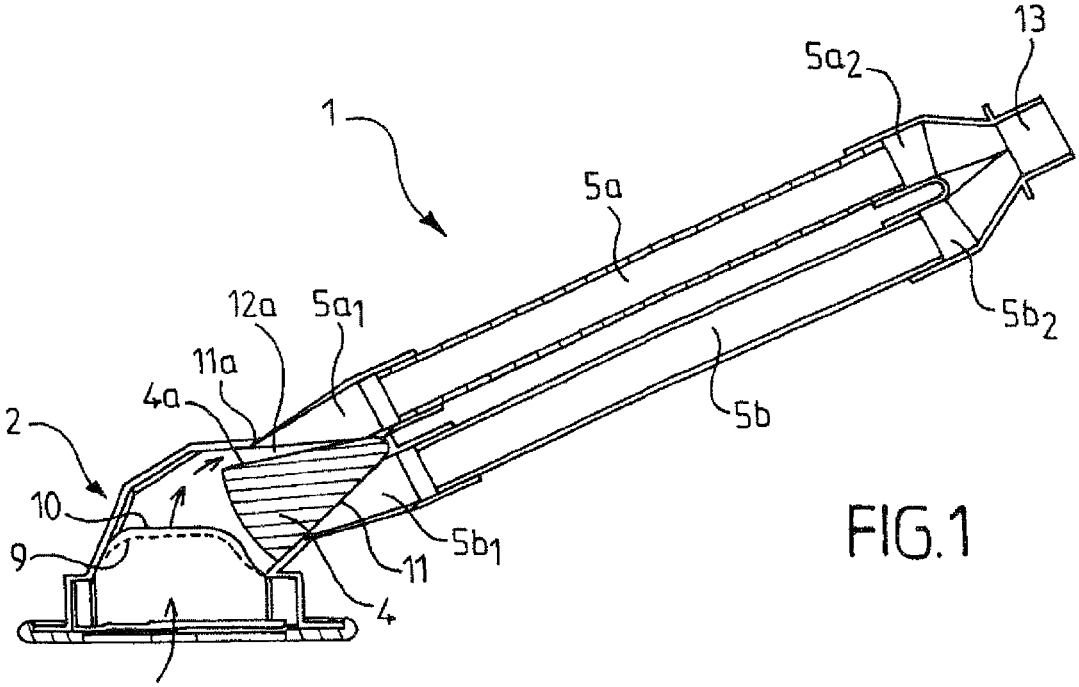
FIG. 1 shows a longitudinal cutaway view of the cleaning device according to an embodiment of this invention when the flap valve is in a blocking position.
Figure 5:
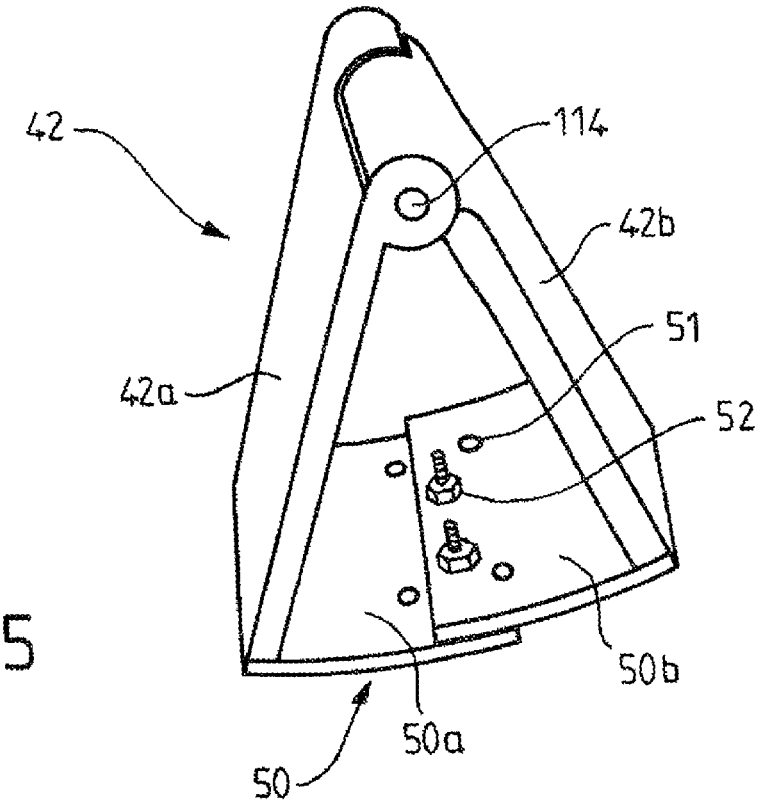

Likewise, FIG. 5 shows a simplified perspective view of another flap valve that is suitable for the device of FIG. 1.

Figure 2:
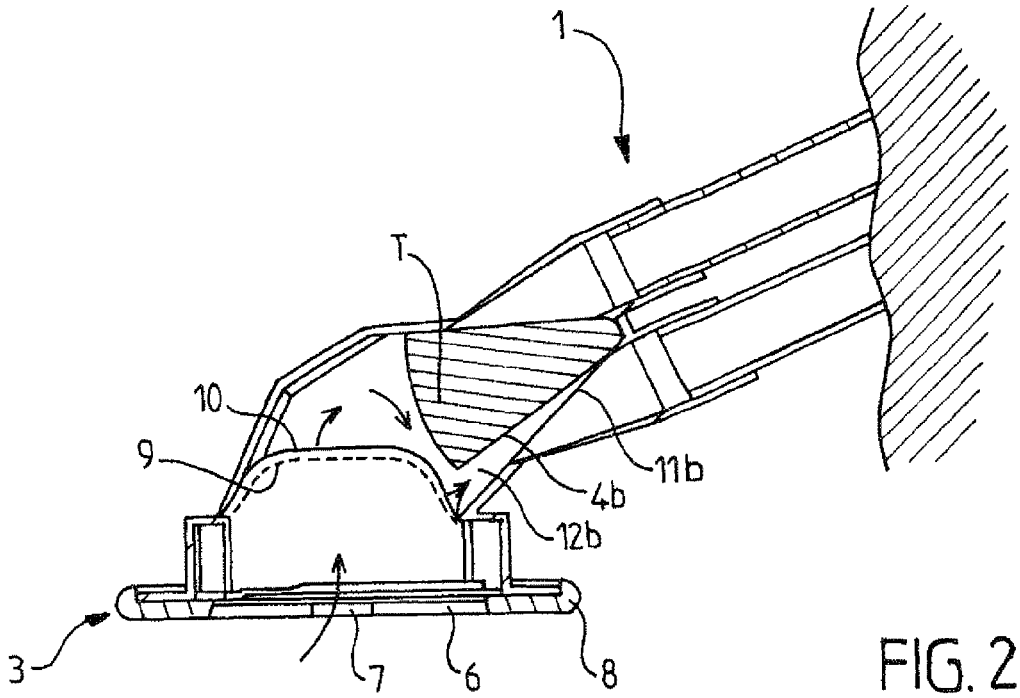
FIG. 2 shows an enlarged longitudinal cutaway view of the hollow head of the device of FIG. 1 when the flap valve is in another blocking position.
Figure 3:
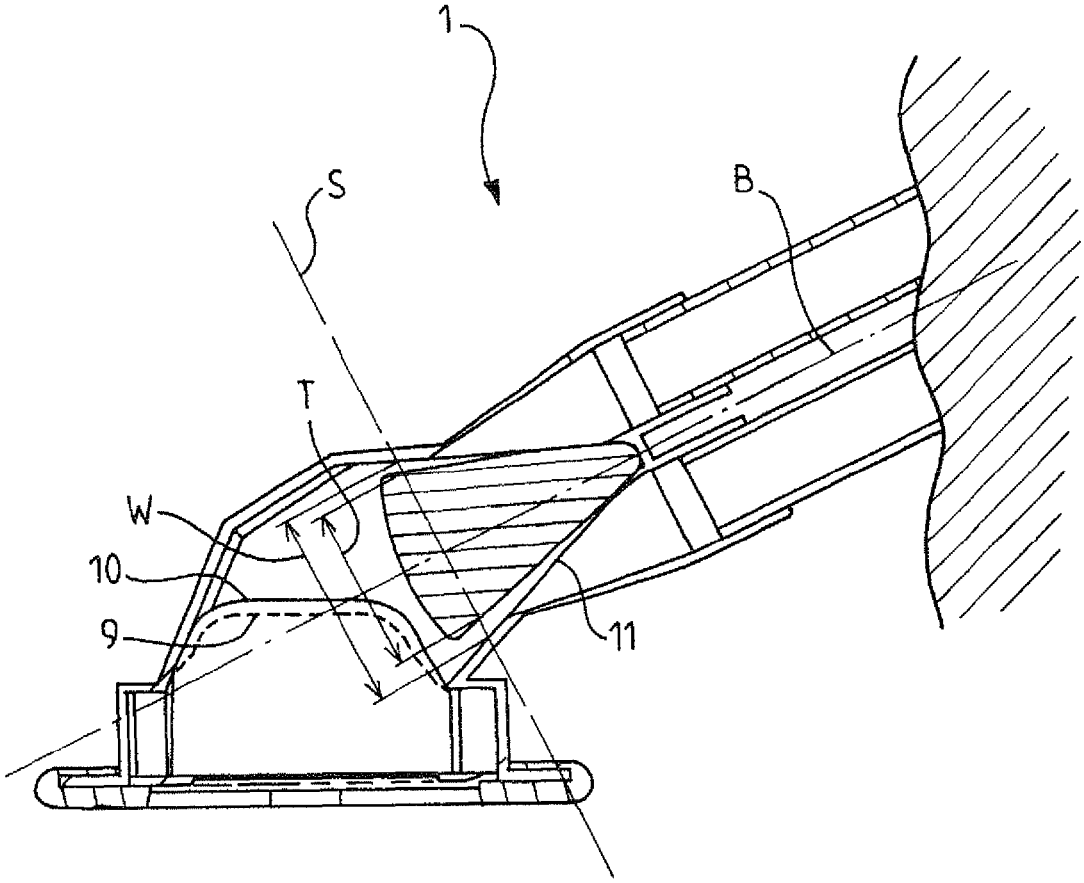
FIG. 3 shows an enlarged longitudinal cutaway view of the hollow head of the device of FIG. 1 when the flap valve is in intermediate position.

As shown in FIGS. 1 to 3, an automatic cleaning device 1 for a surface submerged in a liquid, such as, for example, the walls of a swimming pool, comprises a hollow head 2 that consists of a cap that is generally made of plastic, a flap valve 4, and two intake hoses 5*a*, 5*b*.

Said hollow head 2 comprises said flap valve 4, a holding grid 10, and a prefilter 9 that are all three enclosed under the cap of the hollow head 2, and an intake head 3 that is designed to be in contact with the surface to be cleaned.

Said flat-surface intake head 3 consists of a nonreturn valve 6 that comprises an opening 7 so as to form a passage for the dust and other kinds of debris found on the surface to be cleaned. In contrast the intake head also comprises a flexible sealing flange 8 of elongated shape. The primary function of said flexible sealing flange 8 is to remove and direct the particles of dust or other debris from the surface to be cleaned to the opening 7. This flange 8 is arranged so as to encircle the end of the intake head 3 and therefore the nonreturn valve 6.

The hollow head 2 comprises, arranged in its cap and above the intake head 3, a holding grid 10. More particularly, this holding grid 10 is arranged in the hollow head 2 so that the debris and the drawn-in water pass systematically after their intake into the intake head 3 by said grid 10. It is attached in and to the hollow head 2 by, for example, a clamp. This holding grid 10 can have an approximately cylindrical shape and more particularly a bell shape whose lower end is open and rotated toward the intake head 3, while the upper end, designed to be rotated toward the valve 4, is pierced by openings so as to allow the flow of drawn-in water to pass.

Inside this holding grid 10, preferably made of plastic, a prefilter 9 such as a fine-mesh sieve, preferably made of removable metal, is arranged, whereby said prefilter 9 assumes the shape of said holding grid 10 This prefilter 9 thus has the function of removing not only the large pieces of debris that can be found in the bottom of the swimming pool, such as mud particles, optionally, leaves but also finer particles (i.e., dust) from the water that is drawn in from the swimming pool.

The use of a prefilter, such as the sieve 9, thus has the advantage not only of keeping the flap valve from being clogged by debris within the hollow head 2, but also of solving the problem of premature fouling of the cartridge filter of the swimming pool when the latter is provided with it. The cartridge filter is installed in general behind the skimmer of the swimming pool; it filters impurities from the water using its cartridge made of synthetic material.

The hollow head 2 also comprises a seat 11 under its cap. The seat 11, having first face 11*a* and second face 11*b*, delimits a space in which the flap valve 4 is housed.

The intake hoses 5*a*, 5*b* are parallel to one another as is shown in FIGS. 1 and 2. They each comprise a lower end 5*a*1, 5*b*1 that empties into the hollow head 2 and more particularly at the seat 11, while their upper end 5*a*2, 5*b*2 is connected to a common intake pipe (not shown) using a three-way connection 13, for example by means of a flexible intake pipe (not shown). The common intake pipe is designed to be connected to the suction pump of a swimming pool.

The hoses 5*a*, 5*b* are preferably inclined by an acute angle, preferably on the order of 20° to 30°, and even more preferably on the order of 25° relative to the surface to be cleaned.

This characteristic offers the advantage of operating the cleaning device 1 in fairly shallow water.

The flap valve 4 is held at the hollow head 2 and more particularly at the seat 11 during the operation of the cleaning device 1 by the pressure of the water. Likewise, the pressure of the water will allow the flap valve 4 to oscillate in said seat 11.

In addition, the flap valve 4 has a shape that allows it to work with said seat 11 so as to switch to a first blocking position (for example such as the one shown in FIG. 1) and a second blocking position (for example such as the one shown in FIG. 2) in which it respectively blocks, during operation, hose 5*b* and then hose 5*a*. According to the various blocking positions, the flap valve 4 allows water to pass into the gaps 12*a*, 12*b* that communicate respectively with the lower ends 5*a*1 and 5*b*1 of the intake hoses 5*a*, 5*b*.

The flap valve 4 also has the first face 4*a* and second face 4*b* that will respectively work with the first face 11*a* and second face 11*b* of the seat 11. In general, the flap valve 4 has an essentially triangular section, just like the seat 11.

The flap valve 4 can be partially emptied or not.

Finally, as is shown in FIG. 3, the ratio between the width T of the flap valve 4 and the width W of the seat 11 at a section S of said seat and more particularly at a section that is perpendicular to the bisector B of the faces 11*a*, 11*b* of the seat, is greater than or equal to 70%, preferably on the order of 75% to 85%, and even more preferably on the order of 77% to 80%. This latter characteristic offers the advantage that the passage of water into the gaps 12 is small, bringing about an increase in the velocity of the drawn-in water passing into said gaps 12. As a result, it is not necessary with said device 1 according to this invention to use a high-power suction pump, i.e., on the order of 600 watts. A pump with a power on the order of approximately 100 watts, and even less, allows the cleaning device to operate. However, the small and medium swimming pools are often equipped with low-power pumps. Said device 1 could thus easily be used in this type of swimming pool.

Figure 4:
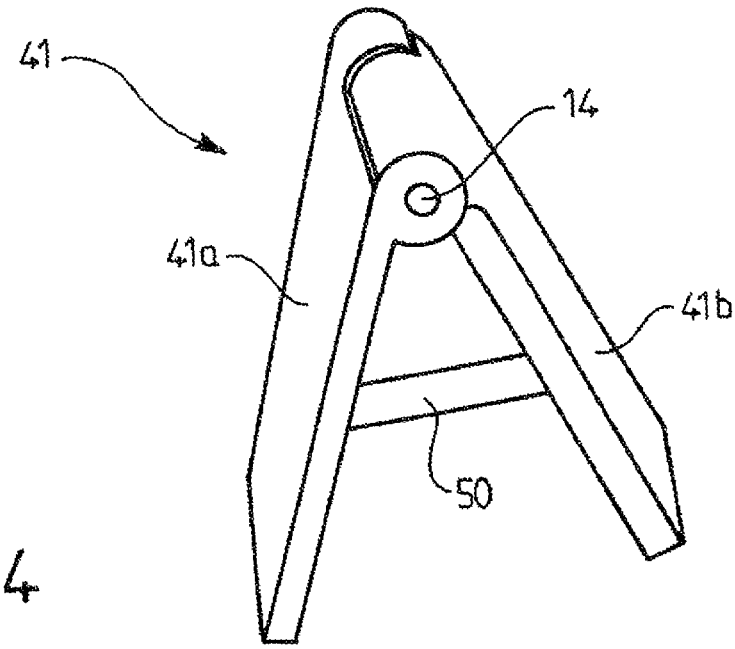
FIG. 4 is a simplified perspective view of a flap valve that is suitable for the device of FIG. 1.

In addition, various flap valve widths, such as those shown in FIGS. 4 and 5, may be suitable for the device 1 according to this invention.

As shown in FIGS. 4 and 5, the valves 41 and 42 are at least partially emptied.

Each valve 41, 42 further comprises one pivot 14, 114, respectively, arranged so as to join the first and second faces 41*a*, 42*a*, 41*b*, 42*b* of said valves 41, 42. In addition, between its first faces 41*a*, 42*a* and second faces 41*b*, 42*b*, the valve 41, 42 comprises a spacer part 50 whose length can be adjusted or pre-adjusted. These two characteristics offer the advantage of making the valves 41, 42 adjustable and adaptable to various widths of seat 11 and also of making their thickness vary, i.e., the spacing between the first and second faces of said valves 41, 42 based on the power of the pump of the swimming pool in which said cleaning device 1 is used.

In a first variant of the adjustable valve and as is shown in FIG. 4, the spacer part 50 can correspond to a bar whose size is selected to obtain good spacing and that is placed between the two faces 41*a* and 41*b* of the valve 41 so as to form a crosspiece.

In a second variant embodiment and as is shown in FIG. 5, the spacer part 50 is also located between the faces 42*a* and 42*b* of the valve 42 so as to form a crosspiece, but at one of their ends, more specifically at the end opposite to the pivot 114. In addition, in this embodiment, one of the faces of the valve 42, here the face 42*b*, is shorter than the other 42*a*, and the spacer part 50 consists of two parts 50*a*, 50*b*, so as to be able to assemble one with the other by attachment means, such as by the screw/nut system 52. For this purpose, the parts 50*a* and 50*b* each have openings 51 that can be juxtaposed so as to be able to accommodate an attachment means (screw/nut).

This characteristic offers the advantage of adapting the width T of the flap valve 41, 42 so as to allow the use of said device in swimming pools comprising pumps of various powers. In this regard, one skilled in the art will be able to adjust the length of the spacer part based on the power of the pump with which the swimming pool to be cleaned is equipped.

In addition, the cleaning device can be partially or entirely made of moldable plastic. For example, the hollow head 2 and the flap valve 4, 41, 42 can be molded in polyurethane.

The installation and the operation of said device 1 during the cleaning of a surface of a small swimming pool equipped with a low-power pump, on the order of 100 watts or less, will now be described using FIGS. 1 and 2.

So as to install said device 1 according to this invention, the user will have to hook up the connection 13, itself connected to another flexible pipe (not shown in the figures) to the pump/skimmer connection or to the sweep intake of the swimming pool. Once connected to the pump of the swimming pool, the water of the swimming pool will be able to be drawn in by means of said device 1 arranged flat on the surface to be cleaned.

Actually, when the device 1 is connected to the pump of the swimming pool, the latter will produce suction at the input of the connection 13 creating the suction of the water at the opening 7 of the nonreturn valve 6 of said device 1. Then, the water will rise, under the action of suction, through the holding grid 10 also by passing through the prefilter 9 like a sieve before going to join the space still left vacant under the cap of the hollow head 2.

The weight in the hollow head 2 will keep said device 1 against the ground, and then the elevated suction of the flow of water between the flexible flange 8 and the ground will cause a flushing-out of aggregates, debris (leaves, mud particles . . . ) located at the bottom of the swimming pool.

In the holding grid 10 that is located in the hollow head 2, these possible pieces of debris drawn in at the same time as the water of the swimming pool will be held by the prefilter 9. The water from which large particles have been removed will then be drawn in through narrow gaps 12*a* or 12*b* located between the seat 11 of the hollow head 2 and the flap valve 4. In a known way, the flow of the water will bring the valve 4 to be positioned against the face 11*a* or the face 11*b* of the seat 11 so as to block respectively the intake hoses 5*a* or 5*b*, even if the valve is in intermediate position before operation (FIG. 3). For example, the water first passes, as is shown by the arrows in FIG. 1, through the gap 12*a* so as to circulate in the hose 5*a*. Since the flap valve 4 covers a large part of the seat 11, the passage of water left vacant 12*a* will be very narrow, consequently increasing the velocity of the water that circulates in said gap 12*a*. This makes it possible for a swimming pool pump on the order of 100 watts or less to drive an automatic cleaning system by which the water will then be sent to the pump and the filter of the swimming pool before returning, once "washed" by the conventional circuit.

The passing of the water from the opening 7 to the gap 12*a* then the hose 5*a* acts on the flap valve 4, forcing it—by a pressure difference between the ends 5*a*1 and 5*b*1 of the hoses 5—to switch to resting on face 11*a* of seat 11 rather than on face 11*b*. This brings about the sudden stopping of the flow of water into the hose 5*a*, which was then relatively high. The kinetic energy of this flow is thereupon transmitted to the rigid structure of said device 1. At the same time, the water that from now on passes through the opening 7, the gap 12*b* and the hose 5*b* as shown by the arrows in FIG. 2 has a low velocity, even zero. Consequently, the flexible flange 8 is no longer bonded to the surface to be cleaned of the swimming pool, such that the device 1 has freedom of movement and can move using the kinetic energy that is transmitted to it.

Then, a stream of water at increasing speed will be established in the circuit: opening 7, gap 12*b* and hose 5*b* again bringing about an adhesion between the intake head 3 and the surface to be cleaned.

Then, just as above, the valve 4 will be directed toward the face 11*b* of the seat 11, and a new operating cycle will begin.

At the end of the operation, the user will be able to easily remove the debris collected in the prefilter 9.

Although the invention has been described in connection with several particular embodiments, it is quite obvious that it is in no way limited and that it comprises all the technical equivalents of the means described as well as their combinations if the latter come within the scope of the invention.

The invention claimed is:

1. A device (1) for automatically cleaning a surface submerged in a liquid, designed to be connected to a pump, comprising:

a hollow head (2) having a seat (11); and first (5*a*) and second (5*b*) suction hoses opening onto said hollow head (2), wherein the seat (11) delimits a space in which a flap valve (4, 41, 42) is housed, said flap valve (4, 41, 42) being adapted to cooperate with said seat (11) so as to adopt first and second closing positions in which it respectively closes the first (5*a*) and second (5*b*) suction hoses when said device (1) is operating, wherein a sieve (9) is arranged inside the hollow head (2) so as to avoid the flap valve (4, 41, 42) from being stuck by any debris in said space, wherein said flap valve (41, 42) is at least partially hollow, wherein the flap valve (41, 42) comprises a spacer (50) arranged between the first (41*a*, 42*a*) and second (42*a*, 42*b*) faces thereof, and wherein a length of said spacer (50) is adjustable.

2. The device according to claim 1, wherein a ratio between a width of the flap valve (4, 41, 42) and a width of said space at a section (S) of said space is greater than 70%.

3. The device according to claim 1, wherein said seat (11) has first (11*a*) and second (11*b*) faces, and said flap valve (4, 41, 42) has first (4*a*, 41*a*, 42*a*) and second (4*b*, 41*b*, 42*b*)

faces, and said first faces or said second faces cooperating together for alternately sealing the first and second hoses pipes.

4. The device according to claim 3, wherein an angle between the first (41*a*, 42*a*) and second (42*a*, 42*b*) faces of the flap valve (41, 42) is adjustable.

5. The device according to claim 2, wherein the section (S) is perpendicular to a bisector (B) of the first (11*a*) and second (11*b*) faces of the seat (11).

6. The device according to claim 1, wherein the hollow head (2) has a flat surface opposite the submerged surface, and the first (5*a*) and second (5*b*) suction hoses have a slope between 20° and 30° with respect to a plane of the surface submerged in the liquid.

7. The device according to claim 6, wherein the slope is 25°.

8. The device according to claim 1, wherein the surface submerged in the liquid is at least one of a bottom, walls, submerged area, and water line of a swimming pool.

* * * * *